US005732317A

United States Patent [19]

Orchard, II et al.

[11] Patent Number: 5,732,317

[45] Date of Patent: Mar. 24, 1998

[54] ROTATING WICK DEVICE

[75] Inventors: James V. Orchard, II, Holley; Borden H. Mills, III, Webster, both of N.Y.

[73] Assignee: Eastman Kodak Company, Rochester, N.Y.

[21] Appl. No.: 667,538

[22] Filed: Jun. 21, 1996

[51] Int. Cl.[6] ..... G03G 15/20

[52] U.S. Cl. ..... 399/325; 399/320; 430/124

[58] Field of Search ..... 399/320, 324, 399/325; 430/99, 124; 118/60

[56] References Cited

U.S. PATENT DOCUMENTS

| | | | |
|---|---|---|---|
| 3,964,431 | 6/1976 | Namiki | 118/60 |
| 4,229,990 | 10/1980 | Steinberg et al. | 74/377 |
| 4,429,990 | 2/1984 | Tamary | 399/325 |
| 4,757,347 | 7/1988 | Tamaoki et al. | 399/325 |
| 4,908,670 | 3/1990 | Ndebi . | |
| 5,043,768 | 8/1991 | Baruch . | |
| 5,045,889 | 9/1991 | Hoover | 399/325 |
| 5,232,499 | 8/1993 | Kato et al. | 118/244 |
| 5,235,394 | 8/1993 | Mills, III et al. | 399/325 |
| 5,482,552 | 1/1996 | Kikukawa et al. | 399/325 X |
| 5,534,986 | 7/1996 | Irro et al. | 399/325 |

FOREIGN PATENT DOCUMENTS

93/08512 4/1993 WIPO .

*Primary Examiner*—Sandra L. Brase
*Attorney, Agent, or Firm*—Lawrence P. Kessler

[57] ABSTRACT

A rotating wick device for applying release oil to a fusing roller or other fuser member includes an elongated hollow distribution tube. A porous ceramic material surrounds the distribution tube and is covered with a porous polytetrafluoroethylene material. Preferably, the polytetrafluoroethylene material includes a first portion adjacent the ceramic material which is of unexpanded polytetrafluoroethylene and a second portion adjacent the first portion which is expanded polytetrafluoroethylene.

7 Claims, 1 Drawing Sheet

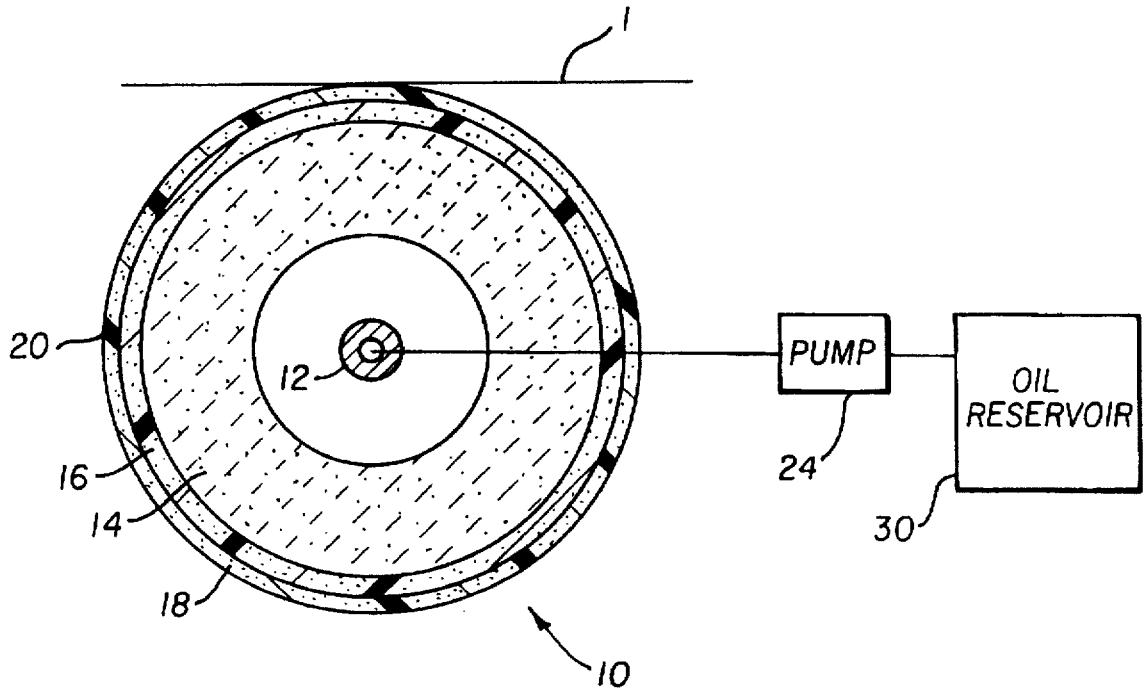
1
20
12
PUMP
OIL
RESERVOIR
16
14
24
30
18
10

ROTATING WICK DEVICE

This invention relates to apparatus for fusing toner images and, more particularly, it relates to a rotating wick device for applying offset preventing liquid to a surface of a fusing apparatus.

U.S. Pat. No. 4,229,990, granted to E. J. Tamary Feb. 7, 1984, discloses a wicking structure for applying release liquid to the surface of a roller in a roller fixing apparatus. Such release liquid (sometimes referred to as "oil") is fed from a reservoir to a replaceable porous applicating wick. The feed tube and wick constitute an application roller which is rotated by the fusing or fixing roller while it oils the surface. The structure has many advantages, including ease in articulation and low wear on the surface being oiled.

The structure shown in that patent is commonly called a "rotating wick" and is presently used commercially in a number of copiers and printers applying high quantities of oil to rollers for 250,000 or more images per wick. The release liquid is delivered to the wick using a pump and a rotatable or stationary feed tube. The feed tube is cylindrical and has small holes through which the liquid can pass. A replaceable wick surrounds the feed tube which includes a porous structure having an inner ceramic porous material that is covered by a porous and heat resistant fabric such as wool or a comparable synthetic fabric. Such a synthetic fabric is marketed by DuPont under the trademark Nomex® and is a well known capillary fabric which is resistant to heat and used for a variety of fusing system wicks.

U.S. Pat. No. 4,908,670, issued Mar. 13, 1990, and U.S. Pat. No. 3,964,431, are also internally fed wicking structures with variations in the porous material used.

U.S. Pat. No. 5,043,768, granted to Baruch Aug. 27, 1991, shows a rotating wick in which the wool or Nomex® wrap has been eliminated and the porous ceramic material directly contacts the surface being oiled. This structure has been shown to have some advantages for some uses. Typical ceramic materials useful in this and in the Tamary wick were composed of aluminum oxide, silicon dioxide and other materials. They are generally off-the-shelf items that can be purchased from a supplier of such porous ceramics.

U.S. Pat. No. 5,232,499 to Kaitoh et al, issued Aug. 3, 1993, and UK Patent Application 2 261 400, are among several patent documents to W. L. Gore Associates, Inc. which show rotating wicks designed for applying oil to a fixing surface in a plain paper copying machine. A porous polytetrafluoroethylene structure is wrapped around a metal tube or porous foam through which release liquid moves from an internal reservoir without a pump. This structure applies liquid at a very slow rate and lasts only as long as the internal supply lasts.

Two problems associated with pumped (and not pumped) rotating wicks, as well as other oil application devices, continue despite all of the advantages of the above art. The first is the general uniformity of the oil applied, regardless of the conditions of use of the machine. The second is the tendency of wicks to apply oil to areas of the fuser that are not being used which can cause a buildup of oil. This latter problem is especially present in a fuser designed to take varying cross-track lengths of substrate. If too little oil is applied to a fusing roll, release of the toner and substrate can degrade to the point where copy jams occur in the fuser or part of the toner image sticks to the fuser roll instead of the substrate. If too much oil is applied to the fuser roll, visual oil stains can occur on the substrate, especially if the substrate is paper.

SUMMARY OF THE INVENTION

It is an object of the invention to improve on the performance of prior rotating wick oil applying devices.

This and other objects are accomplished by a rotating wick device for applying offset preventing oil to a surface in a fuser, the oil applying device including: a) a distribution device through which oil can flow; b) a porous ceramic material surrounding the device; c) and a porous material comprising porous polytetrafluoroethylene (PTFE) around the outer surface of the ceramic material.

According to a preferred embodiment, the polytetrafluoroethylene material is made up of two portions, an inner portion directly contacting the ceramic material, which inner portion is an unexpanded porous polytetrafluoroethylene, preferably wrapped on the ceramic material and a second portion which is a porous expanded polytetrafluoroethylene material, preferably in the form of a sleeve over the unexpanded polytetrafluoroethylene wrap.

Surprisingly, we found that use of the polytetrafluoroethylene materials similar to those suggested in the above-cited W. L. Gore Associates, Inc. disclosures, when applied to a prior ceramic core, provided better overall consistency of oil application, including application when fusing varying cross-track lengths of substrate, than did the other wicks used as suggested in the prior art. This improvement was true even in a high oil lay-down environment with oil pumped to the wick from a reservoir.

BRIEF DESCRIPTION OF THE DRAWING

The FIGURE is a schematic side section of a rotating wick contacting a surface to be oiled.

DETAILED DESCRIPTION OF THE INVENTION

Referring to the FIGURE, a surface 1, for example a fusing roller surface, is to be oiled. The surface is moving and frictionally rotates a wick 10 which is supported about an axis primarily by a usually non-rotatable distribution tube 12 and other known components at the ends of the wick 10, not shown. A pump 24 feeds oil from a reservoir 30 into the distribution tube 12, which liquid exits the distribution tube through small holes, not shown. Coaxial with the distribution tube 12 is the replaceable wick 10 which includes a cylindrical porous ceramic material 14, airspaced from the distribution tube 12. The porous ceramic material 14 can be the same as that presently in commercial use. Such structures can be predominantly aluminum oxide or silicone dioxide and generally include some other material. They are purchased as an off-the-shelf item from a supplier of such materials.

The ceramic material 14 was covered with two materials supplied by W. L. Gore Associates, Inc. The first material 16 is a porous, unexpanded PTFE and was wrapped directly onto the ceramic material for two or three wraps. The second material 18 was a porous expanded PTFE material and was applied as a sleeve 20 over the wrapped unexpanded PTFE.

The ceramic material 14 and the PTFE covering make up the wick 10 which is replaceable over the distribution tube and rotates with respect to it.

Relatively rigorous tests were run with 1) the wick just described, 2) a wick with just the ceramic material directly contacting the fusing roller surface, similar to that described in U.S. Pat. No. 5,043,768, 3) a wick as presently in commercial use in which the same ceramic material is covered with Nomex®, and 4) a wick supplied by W. L. Gore Associates, Inc. and having the same PTFE covering as in wick 1) over a wide diameter metal distribution tube.

All four wicks were tried under three different conditions. The first condition included fusing larger substrates after varying length runs of smaller substrates. The second condition was a long copy run after an overnight (greater than 15 hour) period of nonuse. The third condition was a long copy run after 90 minutes of nonuse.

The uncovered porous ceramic core (wick 2), while applying uniform oil in short runs, applied undesirably low amounts of oil during the middle of the long runs.

The standard wick (wick 3) had difficulty handling the situation in which larger copies were run after long runs of smaller copies. The buildup of oil outside the smaller copy area had a tendency to stain the larger copies.

The metal tube porous PTFE wick (wick 4) stained copies after the long nonuse periods.

The wick fabricated according to the invention with the PTFE covering the ceramic material actually performed better than any of the other wicks. It applied less oil to the fuser roll directly when smaller substrates were run than did the standard wick. It applied less oil after long periods of nonuse than did the porous PTFE metal core wick, and it more consistently delivered sufficient amounts of release oil than did the uncovered ceramic wick.

In the above example, the ceramic material was separated from the distribution tube by about 2 mm. However, in conditions where excess oiling after rest is a problem, much smaller airspaces work better, for example, airspaces less than 1 mm, with an airspace as small as 0.3 mm being particularly effective in this respect.

The invention has been described in detail with particular reference to a preferred embodiment thereof, but it will be understood that variations and modifications can be effected within the spirit and scope of the invention as described hereinabove and as defined in the appended claims.

We claim:

1. A rotating wick device for use in applying offset preventing oil to a surface in a fuser, said device including:

a distribution device through which oil can flow, a porous ceramic material surrounding said distribution device, and a porous polytetrafluoroethylene material surrounding the ceramic material, said polytetrafluoroethylene material including two portions, an inner portion contacting the ceramic material which includes a porous unexpanded polytetrafluoroethylene material and an outer portion contacting the inner portion which includes an expanded polytetrafluoroethylene material, at least the ceramic material and the polytetrafluoroethylene material being rotatable by the surface being oiled.

2. A rotating wick device according to claim 1 wherein the inner portion is wrapped on the ceramic material and the outer portion is a sleeve over the inner portion.

3. A rotating wick device according to claim 1 wherein the distribution device is a non-rotatable elongated hollow distribution tube having a plurality of holes through which oil under pressure can flow.

4. A rotating wick device according to claim 3 further including a reservoir of oil and a pump for delivering oil from the reservoir to the distribution tube.

5. A rotating wick device according to claim 3 wherein the ceramic material is separated from the distribution tube by an airspace of less than 1 mm.

6. A rotating wick device according to claim 5 wherein the airspace is about 0.3 mm.

7. A wick for use in a rotating wick device for applying oil to a surface in a fuser, which rotating wick device has a distribution device through which oil can flow, said wick comprising:

a porous ceramic material positionable over said distribution device, and a polytetrafluoroethylene material surrounding the ceramic material, said polytetrafluoroethylene material including two portions, an inner portion contacting the ceramic material which includes a porous unexpanded polytetrafluoroethylene material and an outer portion contacting the inner portion which includes an expanded polytetrafluoroethylene material.

* * * * *

UNITED STATES PATENT AND TRADEMARK OFFICE

CERTIFICATE OF CORRECTION

PATENT : 5,732,317

DATED : March 24, 1998

INVENTOR(S) : James V. Orchard II, et al.

It is certified that error appears in the above-identified patent and that said Letters Patent is hereby corrected as shown below:

Title page, insert the following:

--Related U.S. Application Data
[60] Provisional application No. 60/006,176, Nov. 2, 1995--.

Column 1, line 2, insert the following:

--CROSS REFERENCE TO RELATED APPLICATION
Reference is made to and priority claimed from U.S. Provisional application Ser. No. US 60/006,176, filed Nov. 2, 1995, entitled ROTATING WICK DEVICE.--.

Signed and Sealed this

FourthDay of August, 1998

Bruce Lehman

*Attest:*

BRUCE LEHMAN

*Attesting Officer*

*Commissioner of Patents and Trademarks*